US008137768B1

(12) United States Patent
Chen

(10) Patent No.: US 8,137,768 B1
(45) Date of Patent: Mar. 20, 2012

(54) CHRISTMAS WREATH

(76) Inventor: Tsung-Wei Chen, Changhua (TW)

( * ) Notice: Subject to any disclaimer, the term of this patent is extended or adjusted under 35 U.S.C. 154(b) by 0 days.

(21) Appl. No.: 12/975,542

(22) Filed: Dec. 22, 2010

(51) Int. Cl.
*A47G 33/00* (2006.01)

(52) U.S. Cl. ..... 428/10; 428/7; 428/11

(58) Field of Classification Search ..... None
See application file for complete search history.

(56) References Cited

U.S. PATENT DOCUMENTS 1,853,305 A * 4/1932 Frei, Jr. ..... 428/10
2,234,835 A * 3/1941 Sexton ..... 428/11
3,747,462 A * 7/1973 Mizuno ..... 84/406
D343,805 S * 2/1994 Bar-Yona ..... D10/116
D577,308 S * 9/2008 Chen ..... D11/121
D577,309 S * 9/2008 Chen ..... D11/121
D579,815 S * 11/2008 Chen ..... D11/121
D608,242 S * 1/2010 Chen ..... D11/121
2010/0304050 A1* 12/2010 Kwok ..... 428/10

* cited by examiner

*Primary Examiner* — Aaron Austin

(57) ABSTRACT

The present invention provides a Christmas wreath, which applies a non-circular metal wire to connect bells, wherein additional positioning members are added between the adjacent bell groups for separation. The non-circular inner hole of the positioning member can obtain a refrained position between the positioning member and metal wire, and prevent arbitrary rotation of the positioning member. The outer rim of the positioning member includes at least one included angle, and formed into an inclined guiding surface to coordinate with the end. This enables the positioning member end to insert into the bell ring concave to obtain a refrained position relation between the positioning member and bell, preventing the bell from arbitrarily rotating. The present invention can truly maintain the pattern of connected bells through the mechanism of the positioning member for the bell and metal wire.

7 Claims, 11 Drawing Sheets

CHRISTMAS WREATH

BACKGROUND OF THE INVENTION (a) Field of the Invention

The present invention relates to an improved Christmas wreath, mainly to decoration wreaths designed of connecting bells, ornaments and other decorations with metal wire. The structure of the present invention enables the connected bells with the metal wire to obtain a stable positioning so that the bells will not have the issue in arbitrary rotating. This enables the removal of additional bells which do not have decoration purpose. Not only does the overall visual appearance is enhanced and maintainable, but also hanging of the wreath becomes even more stable. In addition, the invention greatly reduces the overall cost, having practical values and economic benefits to the industry.

(b) Description of the Prior Art

Heretofore, the common decorations seen during the Christmas holiday are usually bells connected in series to a wreath, bow or other hanging decorations. Referring to FIG. 1 of a general commercial Christmas wreath, comprising of metal wire (1) as the base material, with said metal wire (1) passing through the bell rings (3) to connect and arrange decoration. In order to secure the bell (2) series with the metal wire (1) and avoid bell (2) rotation issues, four bells (2) are generally used as a set unit, which the bell (2) is arranged of a cross-connected pairs of left, right, front and rear set. This arrangement enables the adjacent bell (2) receive and appropriate balanced force to obtain a refrained position, and further to maintain the overall bell series pattern. At the same time, the end of the said metal wire (1) is flexibly connected with the bell set and the other decorations (4) as forming the whole wreath decoration.

From the structure of the previous bell and decoration arrangement, the bell set which attached directly to the metal wire relies on the balancing among the individual bells to obtain an expected limiting in position. However as a matter of fact, the arrangement can only effectively avoid the bell of sliding but unable to prevent the bells from rotation. With the situation, it will become very difficult to maintain the original direction of the designed, resulting in the wreath to have a rather disordered appearance. In addition, this results to an uneven attaching to the wall and affects the overall hanging stability and visual appearance.

Furthermore, in order to obtain a refrained position for the bell, the four-bell cross-connection of the front, rear, left and right is arranged for balance. However, the rear bell is not necessary for decoration, and the only purpose is for pairing to obtain a refrained positioning effect. This type of connecting method cannot truly achieve the expected position limiting purpose. In this way not only is the design unable to effectively solve the issues of bell rotation, but also on the contrary increased the using of unnecessary bells. This implicitly leads to a waste in production cost, which serves with none economic benefits in the industry.

SUMMARY OF THE INVENTION

Due to the existing defect in current bell decorations while connected, the inventor began research and made improvements based on the numerous years of related experience and techniques in the industry, and developed a bell hanging and decoration structure in the present invention. The main purpose is by using a structural design to effectively obtain a positioning relation between the bells and metal wire. This mechanism ensures of preventing the bell from arbitrary sliding, and further provides the bells with a stable positioning, which rotation is impossible, and maintain the original design of the hanging decoration.

In addition to the extreme stable positioning among the bells and metal wire, another objective of the invention, which even more important, is to save the usage of unnecessary bells. This enables a reduction with the overall production cost and also maintains its hanging stability.

In order to achieve the previous disclosed purposes, the structural design of the present invention applies a non-circular metal wire to connect the bells, using additional positioning members to separate adjacent bell groups. The non-circular inner hole of the positioning members can obtain a refrained positioning between the positioned bells sets and metal wire. This prevents the positioning members from arbitrary rotation. In addition, the outer rim of said positioning members is designed with at least one included angle, which the end is designed as an inclined guiding surface. The conveniently enable the positioning member end to insert and connect with the bell ring concave to obtain a refrained position relation with the positioning member and bell, and prevents arbitrary rotation of the bell. The above design forms the positioning structure for connecting bell hanging decorations for the present invention.

DESCRIPTION OF MAIN COMPONENT SYMBOLS

| | |
|---|---|
| (1) Metal wire | (2) Bell |
| (3) Ring | (4) Decoration |
| (10) Metal wire | (11) Even surface |
| (12)(13) Hock | (20) Bell |
| (21) Ring section | (22) Concave |
| (30) Positioning member | (31) Inner hole |
| (32) Even surface | (33) Inclined guiding surface |
| (34) Included angle | (35) Inclined guiding surface |
| (40) Plastic tube | (50) Decoration |

DETAILED DESCRIPTION OF THE PREFERRED EMBODIMENTS

Figure 1:
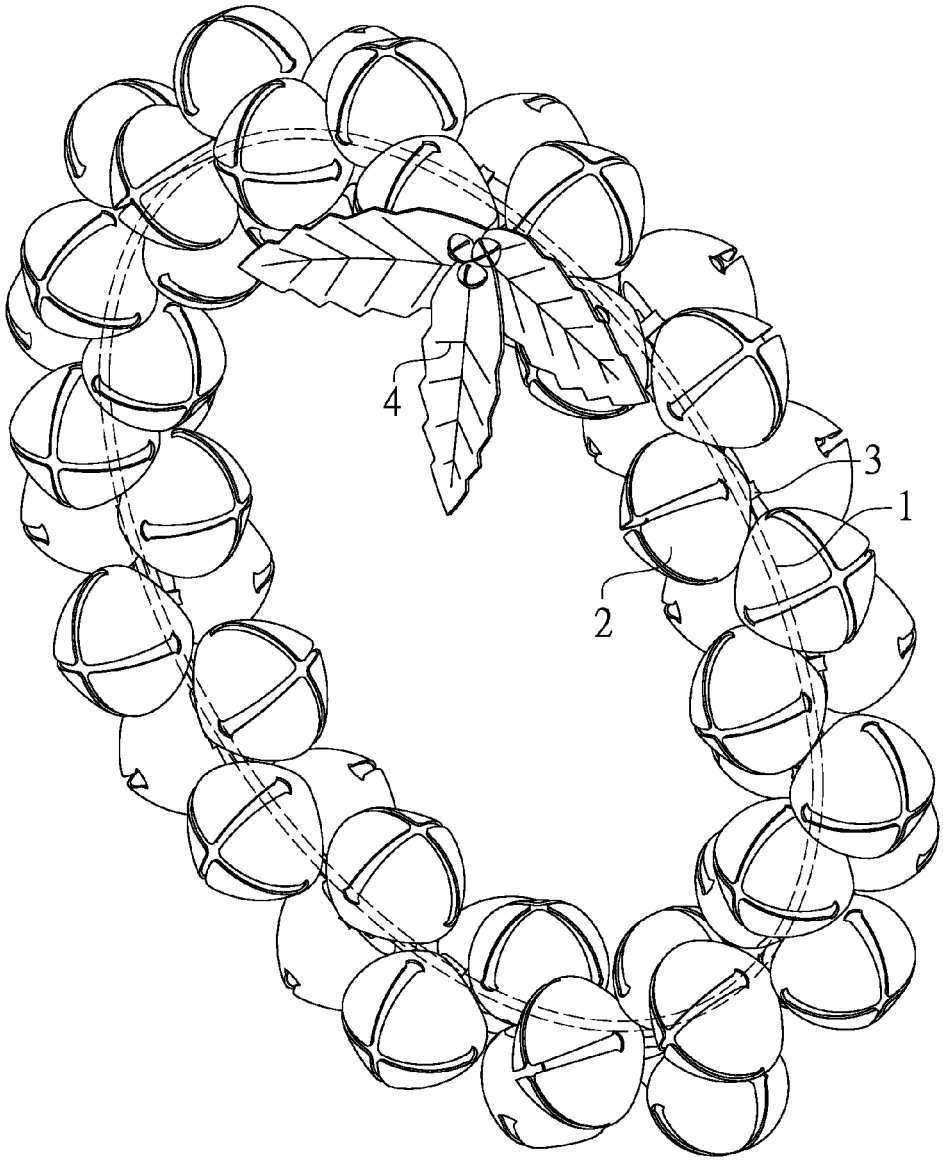
Fig.1 Prior Art
FIG. 1 is a structure illustration of the well-known bell hanging decoration.
Figure 2:
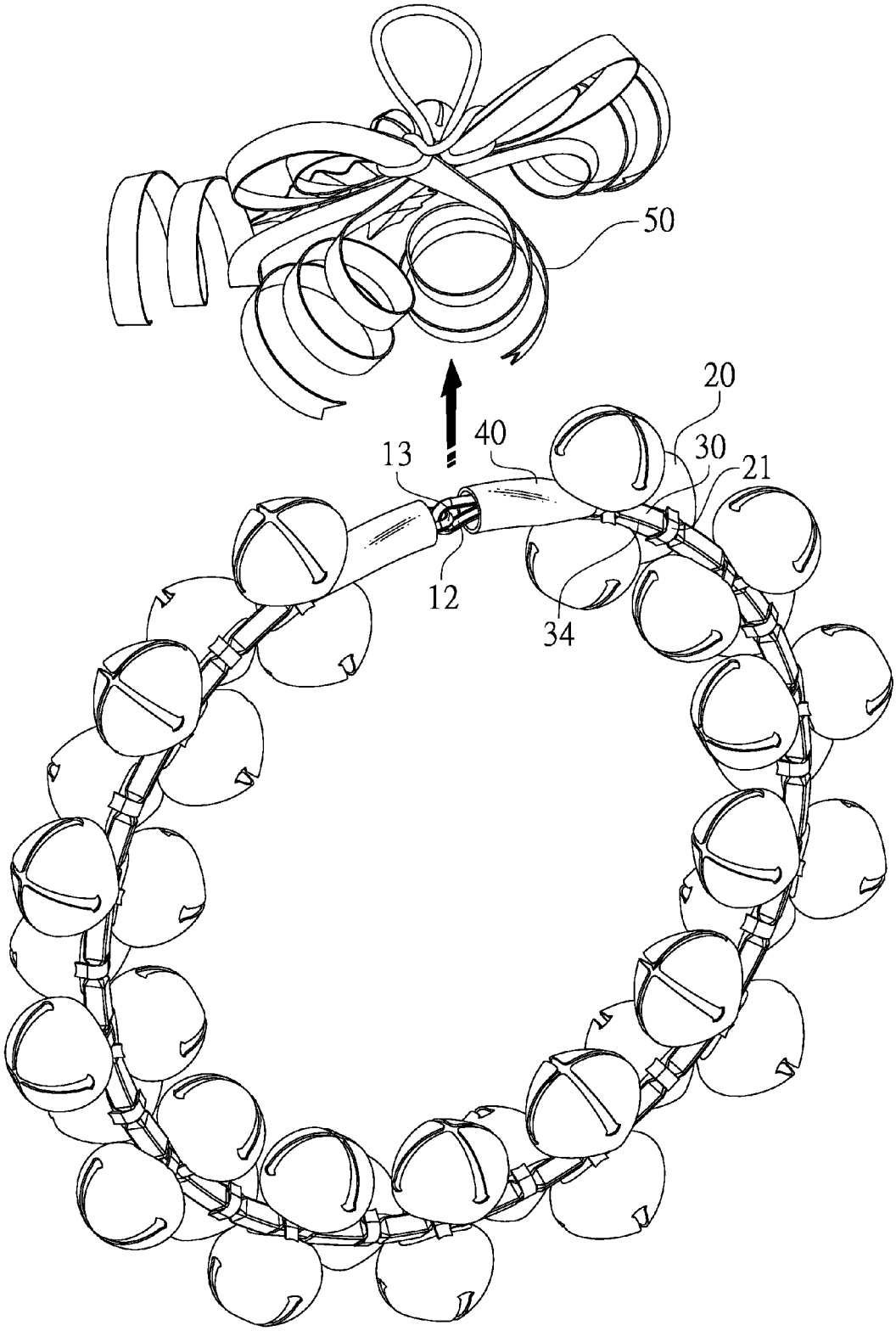
FIG. 2 is a structural view of the present invention in accordance with a preferred embodiment.
Figure 3:
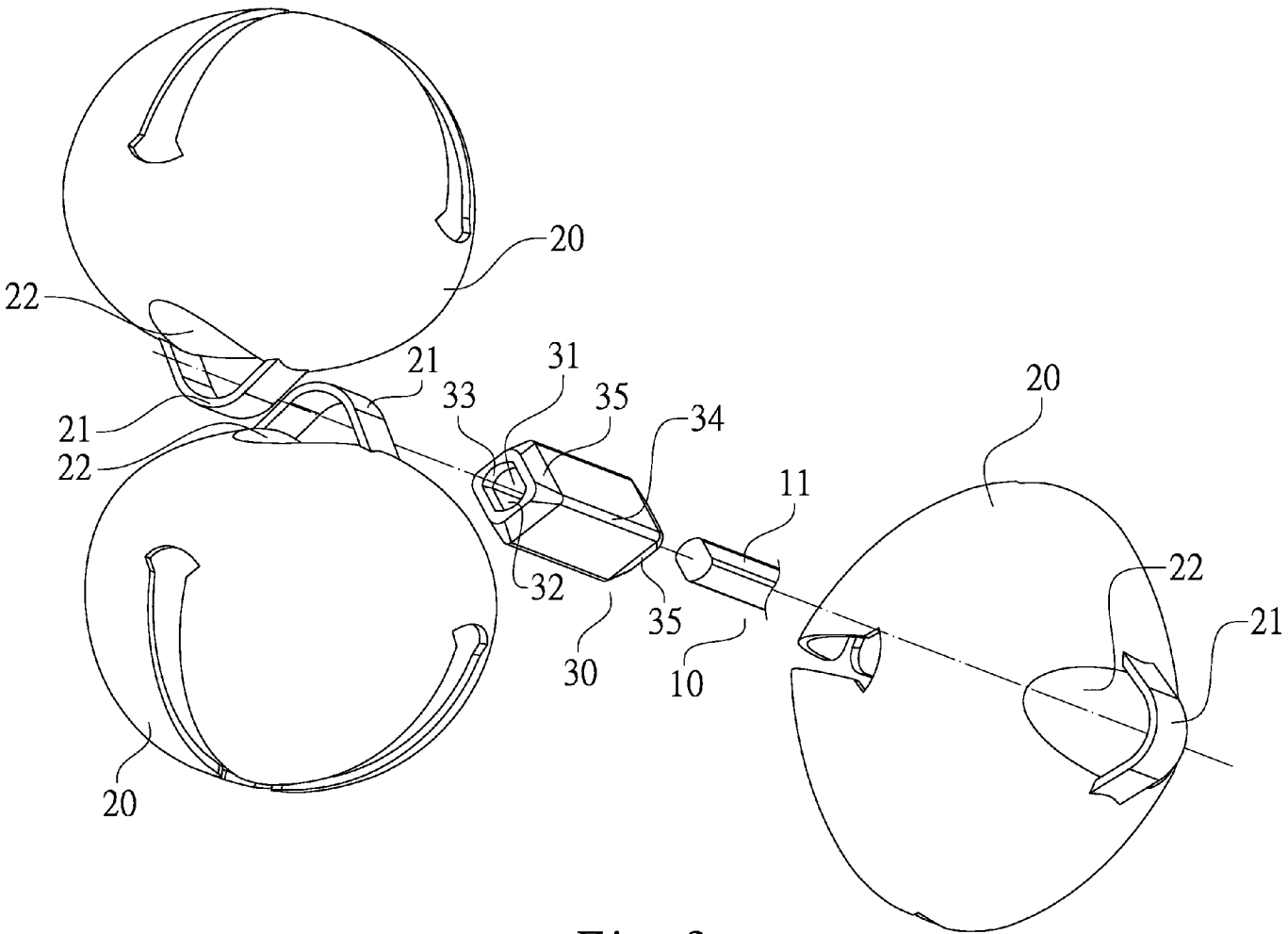
FIG. 3 is a local structural view of the above preferred embodiment.
Figure 4:
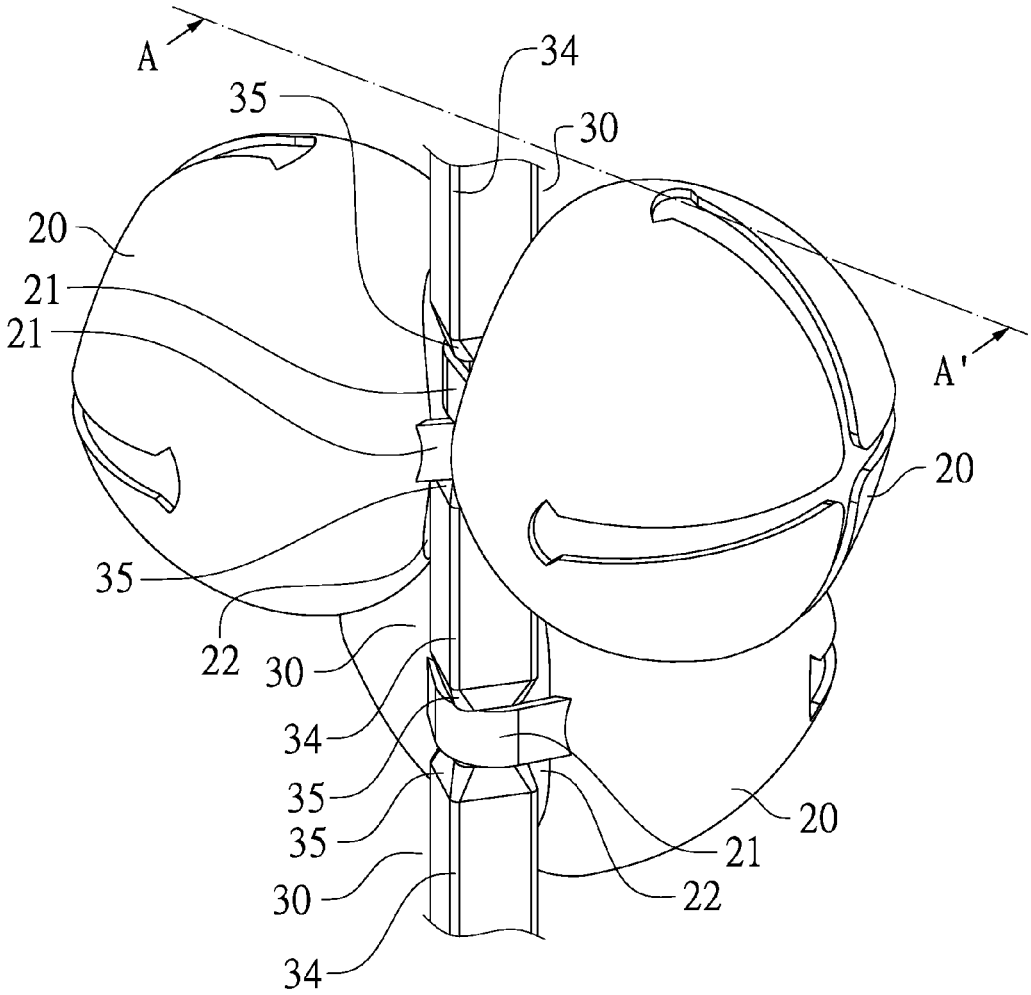
FIG. 4 is a local structural view of the above preferred embodiment.
Figure 5:
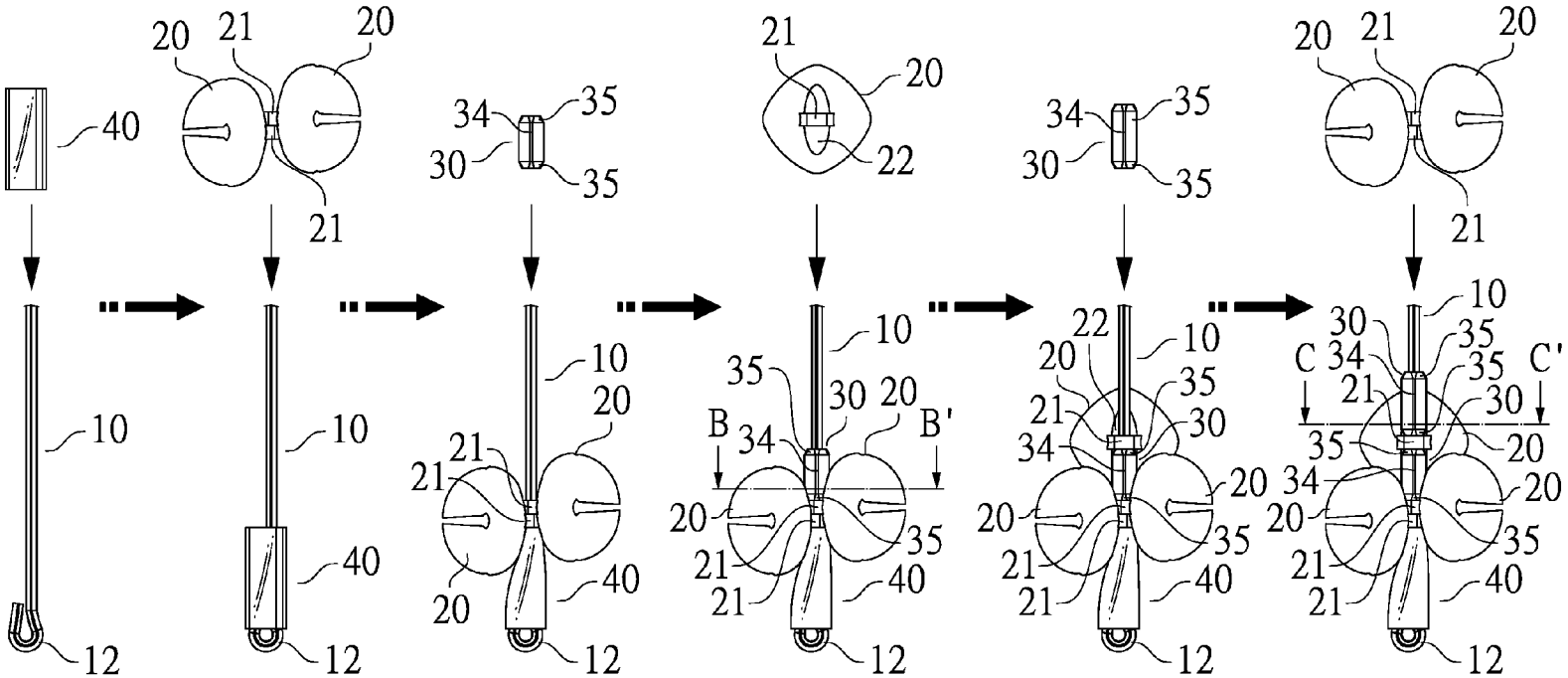
FIG. 5 is an actuation view of the above preferred embodiment.
Figure 6:
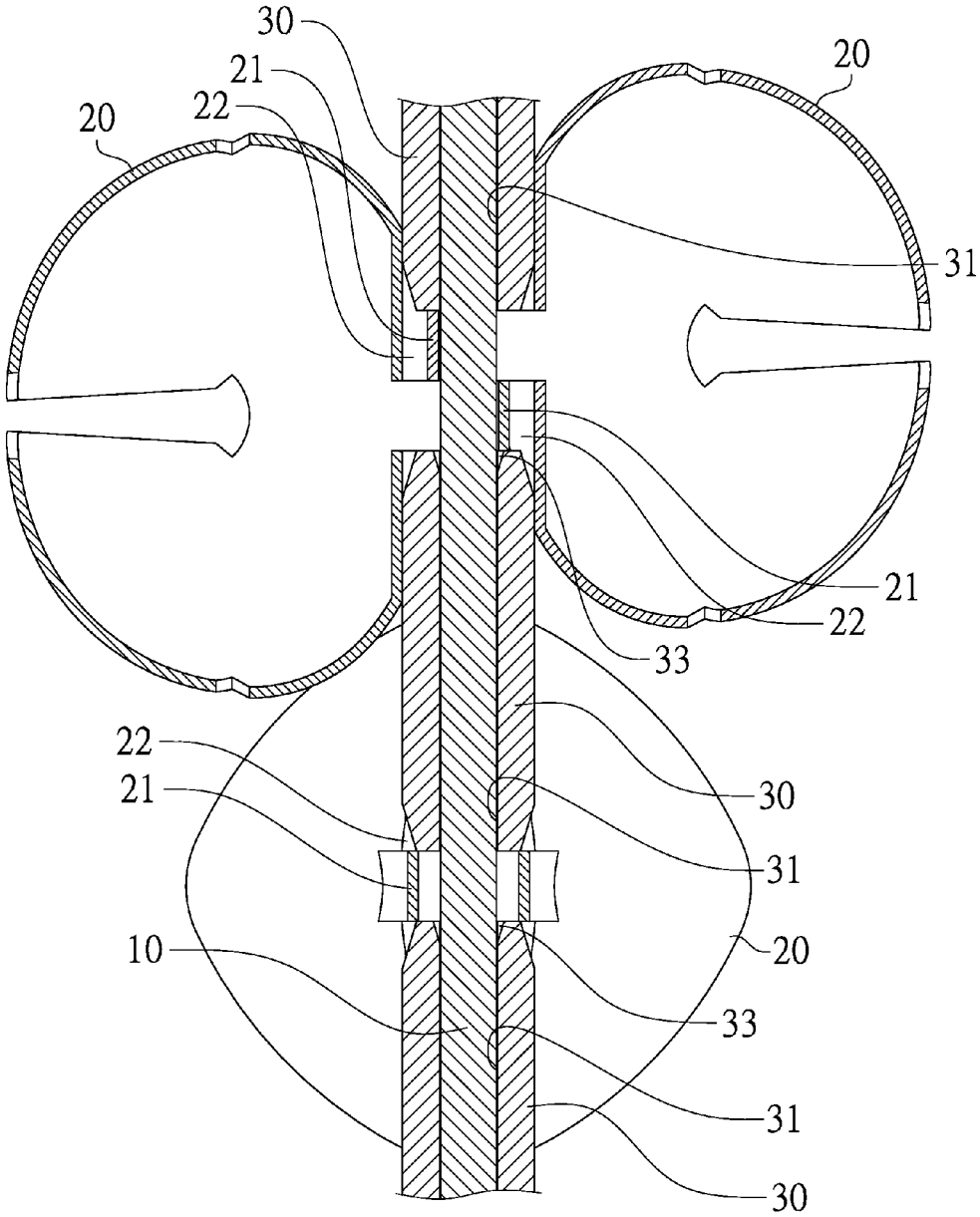
FIG. 6 is a cross-sectional view of the above preferred embodiment from line A-A'.
Figure 7:
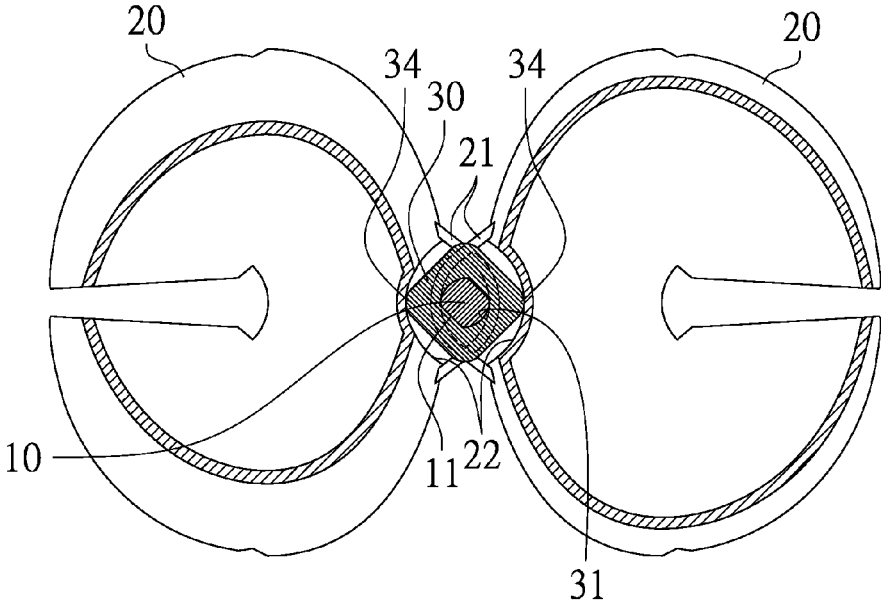
FIG. 7 is a cross-sectional view of the above preferred embodiment from line B-B'.
Figure 8:
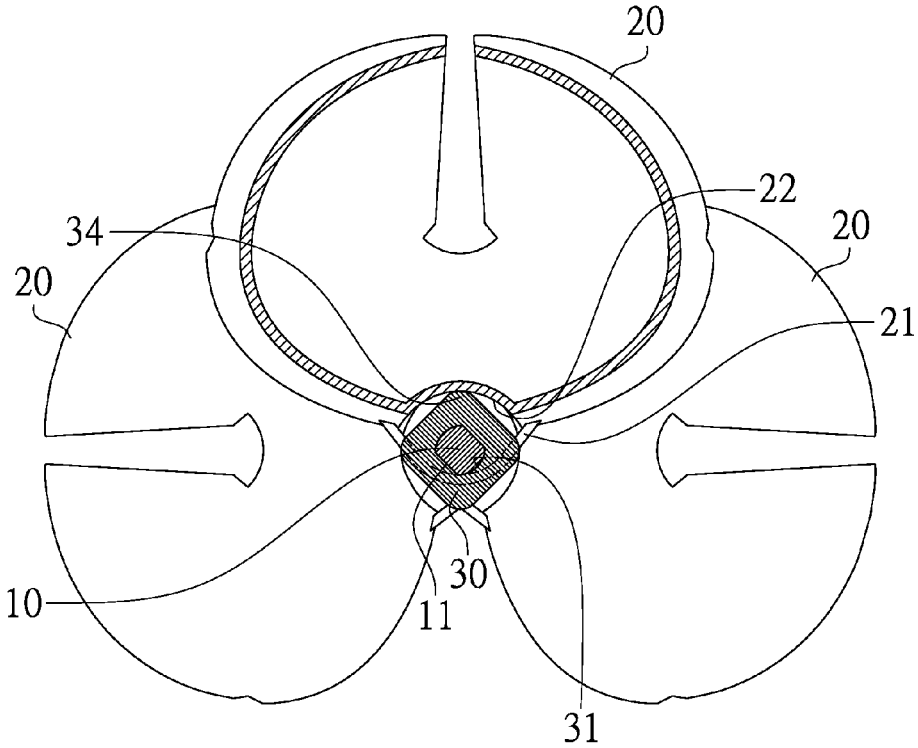
FIG. 8 is a cross-sectional view of the above preferred embodiment from line C-C'.
Figure 9:
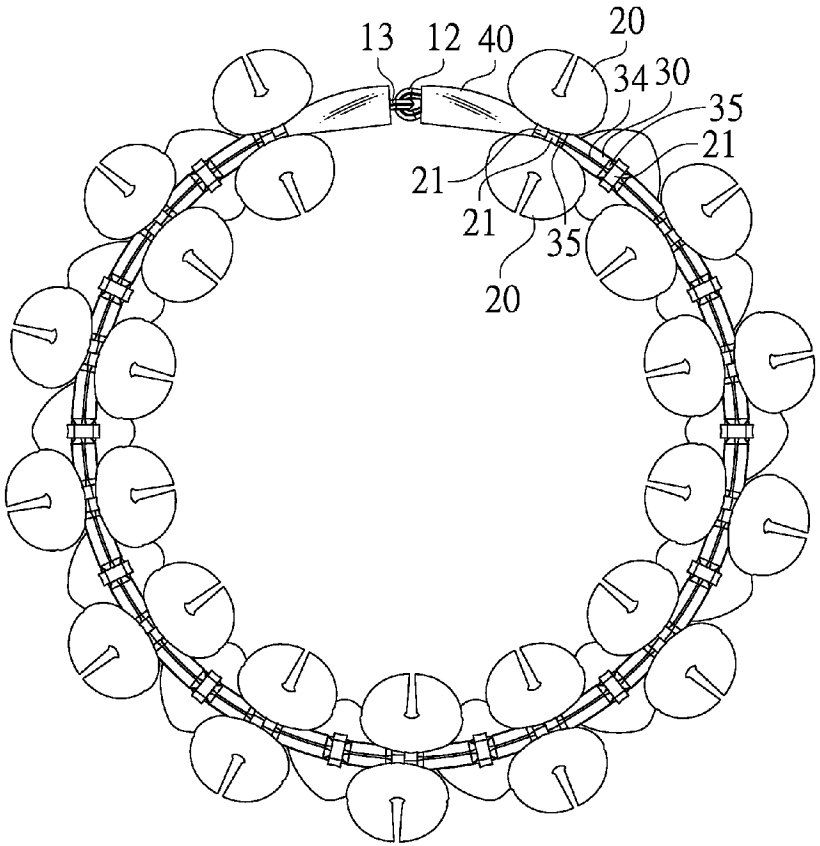
FIG. 9 is a structural view of even of the above preferred embodiment.
Figure 10:
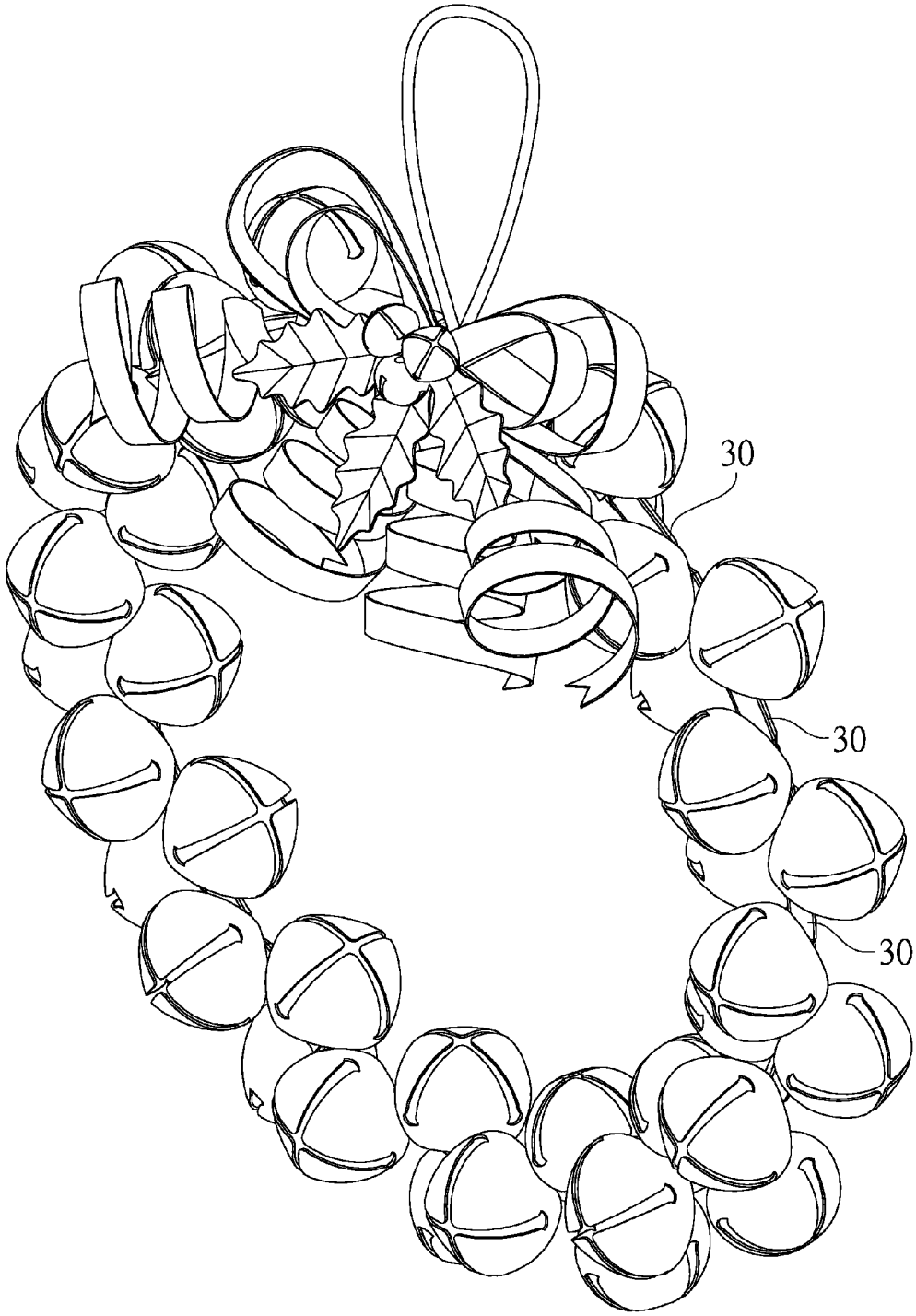
FIG. 10 is a referred implementation view of the above preferred embodiment.
Figure 11:
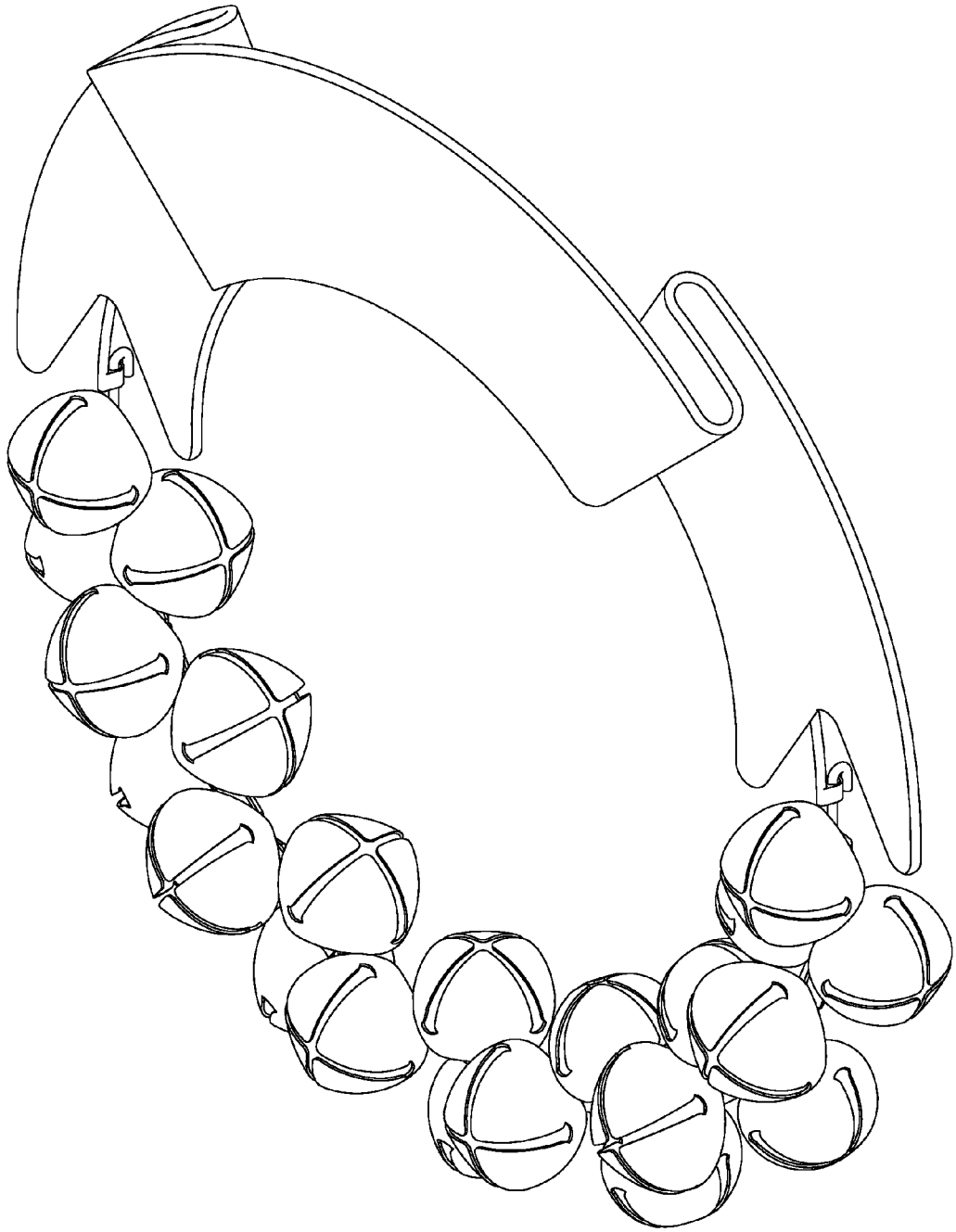
FIG. 11 is a secondary referred implementation view of the above preferred embodiment.
Figure 12:
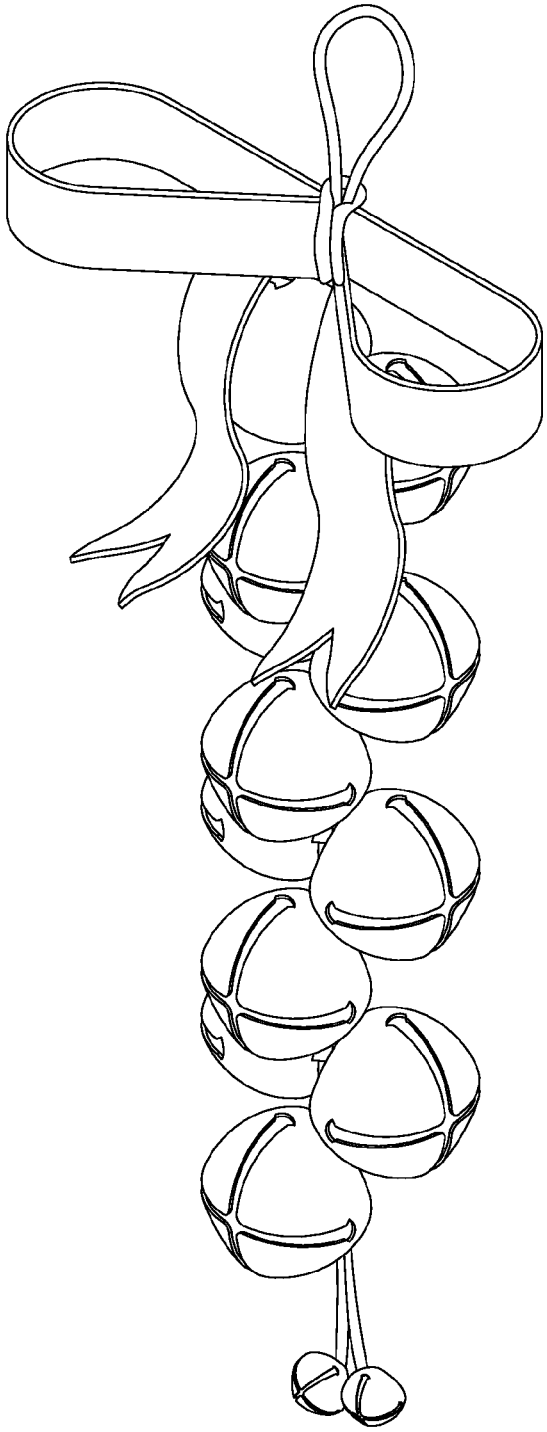
FIG. 12 is another referred implementation view of the above preferred embodiment

The previous description of the present invention and its other technological descriptions, characteristics and performances are described in detail with the drawings and further described of an embodiment:

Referring to the structural view in FIG. 2, the structural exploded view in FICA, the local structural view in FIG. 4, the actuation view in FIG. 5, the structure relation view in FIGS. 6~8, the structure of the even surface in FIG. 9, and referred embodiments in FIGS. 10~12, the present invention applies a metal wire (10) with a certain length to connect the bell (20) series members. The outer diameter of the metal wire (10) includes at least one even surface (11) to form a non-circular pattern (illustrated herein as a flat shape pattern) for the cross-section, wherein the metal wire (10) still has appropriate flexibility. The said bell (20) members include a ring section (21), which the shape of the ring section (21) is concave (22) to the corresponding sides. The ring section (21) of the bell (20) allows the metal wire (10) to connect the bells. The grouping of bells (20) are arranged of using every three bells (20) as one set, which positioning members (30) are used between adjacent bell groups (20). The positioning member (30) is made with plastic material, and the inner hole (31) is produced with at least one even surface (32) to form a non-circular hole shape. The size of the inner hole (31) matches with the outer shape design of the metal wire (10). At the same time, at least the inner rim of one end (or both ends) of the inner hole (31) is made into an inclined guiding surface (33) shape to easily insert the positioning members (30) onto the metal wire (10). The non-circular status forms an appropriate position limiting effect, which the positioning members (30) cannot arbitrarily rotate. In addition, the outer rim of the said positioning member (30) is designed to have at least one or more included angles (34), so that the cross-section forms a multi-angular pattern (illustrated herein as a tetragon). The included angle (34) is further treated to guide the two ends of the positioning (30) set as an inclined guiding surface (35). The design allows the positioning member (30) end to easily insert into the ring section (21) concave (22) of the previous bell (20) to obtain a secured positioning from the positioning member (30) to the bell (20), preventing the bell (20) of arbitrary rotation. The above consists of the Christmas wreath mechanism of this invention;

With the disclosed structure of the design, the mechanism applies a metal wire (10) end folded into a hook (12), inserted into a plastic tube (40), and inserts the left and right bells (30) from the other metal wire (10) end. At the same time the said plastic tube (40) is pushed, which deforms and tightly works against the side of the ring section (21). The positioning member (30) is then inserted, wherein two included angles (34) of the positioning member (30) is inserted into the concave (22) of the ring section (21). The front bell (20) is then connected to the metal wire (10), and then inserted with another positioning member (30). The inserting sequence of left, right and front bells (20) and applying positioning members (20) for separation into the metal wire (10) simultaneously provides appropriate flexibility with the metal wire (10) to obtain the pattern and design for the hanging decoration. When the insertion is completed, another plastic tube (40) is then inserted, and the other end of the metal wire (10) is bended to form another hook (13) to connect with the previous hook (12). The connection site of the two hooks (12) (13) is then tied with the selected decoration (50) to complete the overall designed Christmas wreath connection;

In the described structure design of above, the non-circular inner hole (31) of the positioning member (30) coordinates with the non-circular outer shape of the metal wire (10) to achieve a limiting position relation and prevent arbitrary rotation of the positioning member (30). Furthermore, the external included angle (34) end of the positioning member (30) is designed as an inclined guiding surface (35) to insert and hold the bell (20) in its concave (22), which prevents the bell (20) from arbitrary sliding. As the very same time, the refrained position relation of the positioning member (30) and metal wire (10) makes the positioning member (30) become the interfacial positioning structure for the bell (20) and metal wire (10), which therefore also prevents the bell (20) from arbitrary rotation. Under this connected structure relation, the positioning member (30) achieves the desired bell (20) positioning performance. As a result, the connection can save the original rear bell which is unnecessary. As the number of bells (20) is reduced, this may effectively reduce the overall production cost, and also maintain the flatness of its back side for hanging. The hanging decoration on the wall is closely attached, providing a better overall hanging performance and appearance. The invention can effectively resolve the issue and defects of these types of hanging decorations;

In conclusion with the above description, the present invention relates to the positioning issues of the connected bells on a Christmas wreath, wherein the non-circular design pattern of the metal wire coordinates with the designed positioning member structure design to obtain a positioning member holding the bell concave, and achieving an indirect positioning performance between the bell and metal wire. The design enables the connected bell and metal wire to maintain an extremely stable connection, which effectively prevents arbitrary rotation of the bell and affecting the original hanging decoration design. At the same time, the invention can also reduce production cost, and enhance hanging stability and appearance. From an overall perspective view, the invention is deeply applicable to the industry, having practical value, and is an outstanding innovative design.

What is claimed is:

1. A Christmas wreath comprising:

a metal wire bended into a circle, a plurality of bells connecting to said metal wire with a ring section of these bells and both sides of a ring have a concave section, wherein each bell is grouped with a left side bell and a right side bell connected to the metal wire, and the adjacent left and right bells are inserted into the metal wire with a single front bell inserted in between for separation, and said Christmas wreath including:

at least one or more positioning members, each positioning member having a through inner hole, wherein the size of the inner hole is proportional to the outer shape of the metal wire so that the end of the positioning member can fit into said bell ring concave section, and serve for separation and position tightening for the left, the right and the front bells, wherein these positioned bells maintain the design pattern of the wreath.

2. The Christmas wreath according to claim 1, wherein the outer shape of the metal wire includes at least one even surface so that the cross-section forms a non-circular pattern, which the inner hole of the positioning member also includes at least one or more even surfaces to form a non-circular pattern, wherein the positioning member inserted with the metal wire will maintain a desired position.

3. The Christmas wreath according to claim 1, wherein one end of the inner hole of the positioning member includes an inclined guiding surface, so that the positioning member may conveniently connect to the metal wire.

4. The Christmas wreath according to claim 1, wherein the two ends of the metal wire are folded into hooks to connect together, and a plastic tube is used as the position member between the bell and metal wire.

5. The Christmas wreath according to claim 2, wherein the metal wire having even surface to forms a flat-shape pattern, wherein the even surface of the inner hole of the positioning member matches with said flat-shape pattern of the metal wire.

6. The Christmas wreath according to claim 1, wherein the included angle of the inner hole of the positioning member serves as an angle guide.

7. The Christmas wreath according to claim 1, wherein an outer rim of the positioning member includes at least one or more included angles, wherein both ends of the outer rim of the positioning member consist the included angle and at least one included guiding surface is formed on the outside well of the positioning member.

* * * * *